US006321496B1

(12) United States Patent
Martin, Jr.

(10) Patent No.: US 6,321,496 B1
(45) Date of Patent: Nov. 27, 2001

(54) INSULATED FORM ASSEMBLY FOR A POURED CONCRETE WALL

(76) Inventor: Robert Martin, Jr., 1305 Rochester Rd., Oakland Township, MI (US) 48363

( * ) Notice: Subject to any disclaimer, the term of this patent is extended or adjusted under 35 U.S.C. 154(b) by 0 days.

(21) Appl. No.: 09/179,718

(22) Filed: Oct. 27, 1998

(51) Int. Cl.[7] ..... E04B 2/86

(52) U.S. Cl. ..... 52/364; 52/439; 52/592.6

(58) Field of Search ..... 52/376, 426, 440, 52/441, 442, 431, 432, 435, 439, 427, 428, 364, 434, 592.6, 375, 367, 368

(56) References Cited

U.S. PATENT DOCUMENTS 4,696,140 * 9/1987 Marshall ..... 52/442
4,860,515 * 8/1989 Browning, Jr. ..... 52/426
5,014,480 5/1991 Guarriello et al. .
5,123,222 6/1992 Guarriello et al. .
5,457,926 * 10/1995 Jensen ..... 52/606
6,018,922 * 2/2000 McKinnon ..... 52/376

* cited by examiner

*Primary Examiner*—Michael Safavi
(74) *Attorney, Agent, or Firm*—Bliss McGlynn & Nolan, P.C.

(57) ABSTRACT

An insulated form assembly for a poured concrete wall includes a plurality of insulated forms. Each insulated form includes two generally planar opposing panels, and a plurality of interior segments interconnecting the panels and defining a plurality of passageways. Each panel includes a vertically extending attachment channel and an attachment member disposed within the attachment channel.

13 Claims, 1 Drawing Sheet

INSULATED FORM ASSEMBLY FOR A POURED CONCRETE WALL

BACKGROUND OF THE INVENTION

1. Field of the Invention

The present invention relates generally to poured concrete walls and, more particularly, to an insulated form assembly for a poured concrete wall.

2. Description of the Related Art

Conventional concrete wall construction is well known in the art of building a structure. For example, in a house, basement walls may be constructed of poured concrete. To build a poured concrete wall, a temporary form is prepared in the desired shape of the wall. In the past, the form was made from plywood or metal. Recently, the forms have been made from other materials, including foamed plastic. The form is usually constructed at the site of the structure.

The form is maintained in an upright position during the construction process using extensive bracing. For example, 2×4 studs may be used as braces. After the form is prepared, concrete is poured into the form and allowed to harden. The form is then removed from the hardened concrete wall.

Recently, concrete walls have been constructed from a combination of materials, to improve their insulating efficiency. In an insulated concrete wall, the wall is made from a combination of an insulating material and concrete. The insulating material is a permanent form, which becomes an integral part of the wall. Usually, the form is made from an insulating material, such as a dense plastic foam. Advantageously, a wall section may be pre-assembled from a plurality of forms and transported to the construction site for assembly into the desired shape of the structure. An example of a preassembled insulated form assembly is disclosed in U.S. patent application Ser. No. 09/108,741, filed Jul. 1, 1998 entitled "Insulated Form Assembly For Poured Concrete Wall", which is hereby incorporated by reference. After the walls are assembled, passageways within the insulated form assembly are filled with concrete to complete the walls of the structure. The resulting insulated concrete wall has the strength of a poured concrete wall, with the additional advantages of providing thermal and acoustical insulation, an air and vapor barrier, and exterior wall sheathing. The disadvantage of such an insulated concrete wall is that another object cannot be directly attached to the wall due to the tensile characteristics of the insulated material. Therefore, there is a need in the art to provide an insulated form assembly for a poured concrete wall that allows attachment of an object to the wall with improved tensile characteristics.

SUMMARY OF THE INVENTION

It is, therefore, one object of the present invention to provide a new and improved insulated form assembly for a poured concrete wall.

It is another object of the present invention to provide an insulated form assembly for a poured concrete wall that includes an integral attachment member.

To achieve the foregoing objects, the present invention is an insulated form assembly for a poured concrete wall. The insulated form assembly includes a plurality of insulated forms. Each insulated form includes two generally planar opposing panels and a plurality of interior segments interconnecting the panels and defining a plurality of passageways. each panel includes at least one channel and an attachment member disposed within the channel to allow an object to be attached thereto.

One advantage of the present invention is that an insulated form assembly is provided for constructing an insulated poured concrete wall that offers improved strength, thermal and acoustical insulation, and acts as an air and vapor barrier. Another advantage of the present invention is that the insulated form assembly provides an attachment member for attaching an object to the wall. Yet another advantage of the present invention is that a shape of the attachment member improves retention of an object mounted to the wall. Still another advantage of the present invention is that the attachment member may allow drainage for moisture within the poured concrete wall.

Other objects, features and advantages of the present invention will be readily appreciated as the same becomes better understood after reading the subsequent description when considered in connection with the accompanying drawings.

DESCRIPTION OF THE PREFERRED EMBODIMENT(S)

Figure 1:
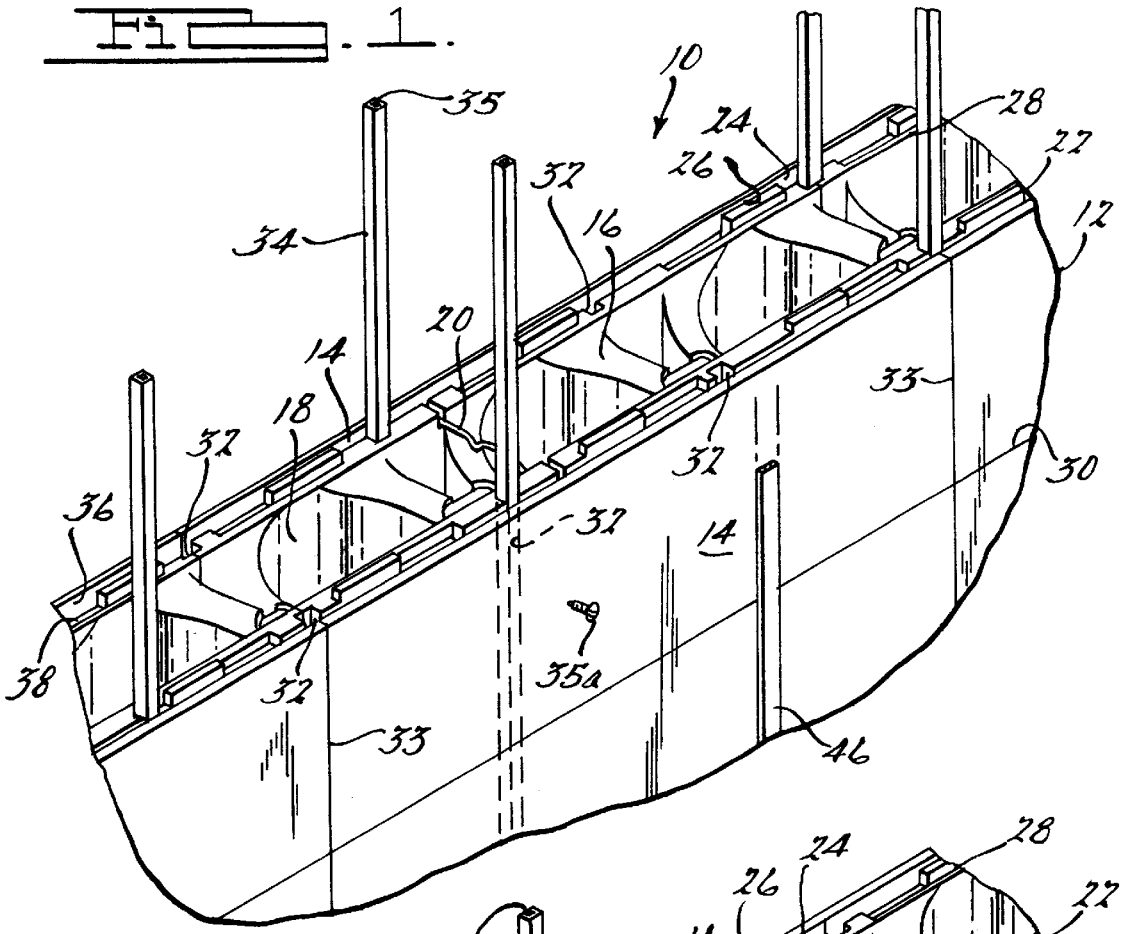
FIG. 1 is a perspective view of an insulated form assembly, according to the present invention, for a poured concrete wall.

Referring to FIG. 1, one embodiment of an insulated form assembly 10, according to the present invention, is illustrated for a poured concrete wall (not shown). The insulated form assembly 10 includes a plurality of interconnected forms, generally indicated at 12. Each form 12 includes two generally planer opposing panels 14. Each form 12 also includes a plurality of interior segments 16 interconnecting the panels 14 and forming a plurality of passageways 18, which are later filled with poured concrete, in a manner to be described. The panels 14 and segments 16 are made from an insulated foam material, such as Styrofoam. It should be appreciated that the panels 14 and segments 16 are integral, unitary, continuous and formed as one-piece.

Each form 12 also includes a supporting member 20 positioned within the passageway 18 and extending generally perpendicular to the panels 14 to provide additional structural strength to the finished insulated poured concrete wall. In this example, each panel 14 is approximately 30" long, 12" wide, and 2" deep. Similarly, each form 12 is approximately 30" long, 12" wide and 10" deep. Preferably, an exterior surface of the panel 14 includes a decorative pattern (not shown), such as to resemble a concrete block.

Each form 12 further includes an interlocking portion 22 for fittingly engaging with another form 12 in a manner to be described. In one embodiment, the interlocking portion 22 is a pair of alternating projecting members 24 extending longitudinally and recessed portions 26 positioned on either one of an upper edge 28 or a lower edge 30 of the panel 14.

Each form 12 also includes at least one, preferably a plurality of attachment channels 32 extending generally vertically through each panel 14. Preferably, the attachment channels 32 are at a seam 33 on opposed sides. The attachment channels 32 are spaced preferably every 10 inches or evenly spaced in other types of forms 12. The attachment channel 32 has a generally rectangular shape. Each form 12 also includes an attachment member 34 disposed within each attachment channel 32. Preferably, the attachment member 34 is made from a rigid material such as metal. The attachment member 34 has a generally rectangular closed shape. The attachment member 34 has a passageway 35 extending axially therethrough. It should be appreciated that in constructing a wall, the forms 12 are positioned so that the attachment channel 32 in one form 12 is aligned with a corresponding channel 32 in a vertically adjacent form 12, to form a single, unitary channel.

Figure 2:
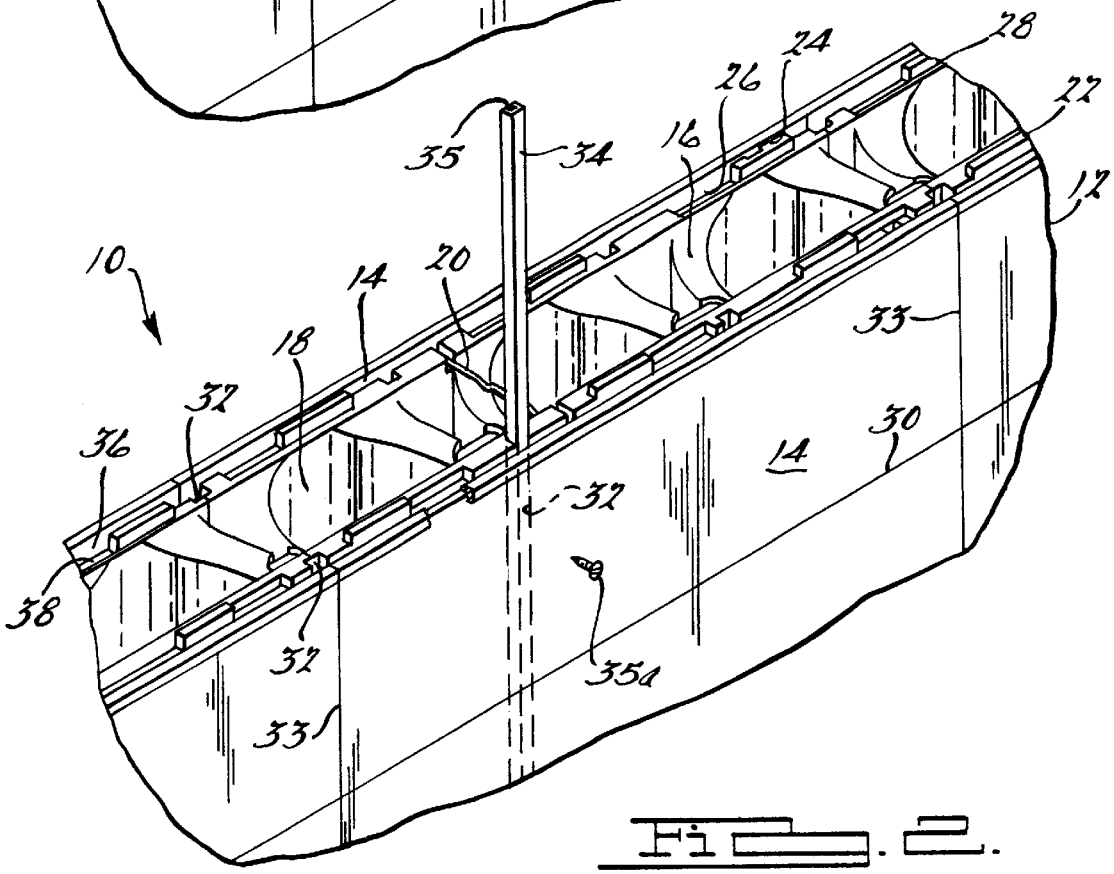
FIG. 2 is a perspective view of another embodiment of an attachment member, according to the present invention, for the insulated form assembly of FIG. 1.

In another embodiment, the attachment member 34 has a generally open U-shape as illustrated in FIG. 2. The U-shape of the attachment member 34 allows the passageway 35 to drain moisture away from the insulated form assembly 10.

Advantageously, an object, such as drywall (not shown) can be mounted directly to the insulated form assembly 10, since the attachment member 34 provides a rigid surface for retaining a fastener 35*a*. For example, in finishing an interior of a structure, drywall may be secured to the wall through the attachment member 34 by the fastener 35*a*. In another example, a stud (not shown) may be attached to the attachment member 34 by the fastener 35*a*, such as in framing an interior wall. If additional surface area for attaching purposes is desired, the form 12 may include an attaching strip 36 held in a groove 38, in either one of the upper edge 28 or the lower edge 30 of the panel 14. Preferably, the attaching strip 36 is made of a rigid material such as metal and has a generally rectangular closed shape or a generally open U-shape. The attaching strip 36 may include a longitudinally extending rib (not shown) for reinforcement. It should be appreciated that the attaching strip 36 is similar to the attachment member 34. It should also be appreciated that in interconnecting forms 12, one longitudinally extending edge of the attaching strip 36 fits within the groove 38 of one form 12, and the other longitudinally extending edge of the attaching strip 36 fits within the groove 38 of a vertically adjacent form 12.

To construct the insulated form assembly 10, a plurality of individual forms 12 are interconnected, such that each projecting member 24 is seated within a corresponding recessed portion 26, so that each form 12 is aligned and locked. If an attaching strip 36 is utilized, one longitudinally extending edge of the attaching strip 32 is placed in the groove 38 in the upper edge 28 of one form 12, and the attaching strip 36 fits within the corresponding groove 38 of a vertically adjacent form 12. It should be appreciated, that the forms 12 are arranged so that an attachment channel 32 in a form 12 is in vertical alignment with an adjacent form 12, to form a single, unitary attachment channel 32. A plurality of interconnecting forms 12 are interconnected, until the desired height is attained. The attachment member 34 is placed in the attachment channel 32. It should be appreciated that the width and/or height of the insulated form assembly 10 can be extended by connecting form assemblies 10 to each other.

The pre-assembled insulated form assembly 10 may include at least one band or strip 46 circumscribing the insulated form assembly 10, to hold it together during shipping, handling and installation at the construction site. Alternatively, a fastener such as a screw could be screwed through top and bottom attaching strips 36 in place of bands 46. Preferably, the band 46 is made of a metal material, although it could be of another rigid material, such as a plastic. It should be appreciated that the ends of the band 46 may be secured by a retaining mechanism (not shown), such as a clip, as is known in the art. Advantageously, one end may be looped prior to inserting onto the retaining mechanism, to form a handle. Advantageously, the insulated form assembly 10 is lightweight for ease of transportability and maneuverability.

To build a structure using the insulated form assemblies 10, a building site (not shown) is excavated and prepared, as is known in the art. Footings (not shown) for supporting the structure are installed corresponding to the shape of the structure. For example, the footings may be of concrete block. A pre-assembled insulated form assembly 10 is then placed in the desired position. Individual pre-assembled insulated form assemblies 10 may then be secured together as previously described. Each insulated form assembly 10 is braced with braces (not shown).

Preferably, a catwalk (not shown but well known in the art) is secured to the insulated form assembly 10. The catwalk provides accessability to pour concrete into the insulated form assembly 10. The catwalk includes a hanger (not shown), which supports a plank (not shown) positioned on a vertical surface of the hanger. For example, the hanger may be secured to the insulated form assembly 10 by hanging the hanger over an end of the attachment member 34 protruding from the uppermost edge of the form 12. The hangers may be spaced an appropriate distance apart.

After the installed insulated form assembly 10 is in place, and braced, concrete is poured into the passageways 18. A worker (not shown) can walk along the plank while directing the pouring of the uncured concrete cement. The concrete cement flows through and fills each channel 18 within the insulated form assembly 10. After the concrete cures or hardens, the banding and bracing may be removed from the completed insulated poured concrete wall.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An insulated form assembly for a poured concrete wall comprising:

a plurality of insulated forms made of a foam material;

each of said insulated forms including two generally planar opposing panels and a plurality of interior segments interconnecting said panels and defining a plurality of passageways;

each of said panels including at least one internal channel extending generally vertically through each of said panels; and a metal attachment member disposed within and extending through said at least one channel and said panels to interconnect said forms to a desired height and allow an object to be attached thereto; and at least one fastener extending through said foam material to engage said attachment member to attach the object thereto.

2. An insulated form assembly as set forth in claim 1 wherein said channel is rectangular.

3. An insulated form assembly as set forth in claim 1 wherein said attachment member is rectangular.

4. An insulated form assembly as set forth in claim 1 wherein said attachment channel in one of said forms is vertically aligned with said attachment channel in another one of said forms.

5. An insulated form assembly as set forth in claim 1 wherein each of said forms includes an interlocking portion for fittingly engaging with another of said forms.

6. An insulated form assembly for a poured concrete wall comprising:

a plurality of insulated forms made of a foam material;

each of said insulated forms including two generally planar opposing panels and a plurality of interior segments interconnecting said panels and defining a plurality of passageways;

each of said panels including at least one channel extending generally vertically through each of said panels;

an attachment member disposed within and extending through said at least one channel and said panels to interconnect said forms to a desired height and allow an object to be attached thereto; and wherein said attachment member includes a passageway.

7. An insulated form assembly for a poured concrete wall comprising:

a plurality of insulated forms made of a foam material;

each of said insulated forms including two generally planar opposing panels and a plurality of interior segments interconnecting said panels and defining a plurality of passageways;

each of said panels including at least one channel extending generally vertically through each of said panels;

an attachment member disposed within and extending through said at least one channel and said panels to interconnect said forms to a desired height and allow an object to be attached thereto; and wherein said attachment member is U-shaped.

8. An insulated form assembly for a poured concrete wall comprising:

a plurality of interlocking insulated forms made of a foam material, wherein each of said forms includes two generally planar opposing panels interconnected by a plurality of interior segments defining a plurality of passageways for receiving concrete, and an interlocking portion for fittingly engaging with another of said forms;

each of said panels including a substantially rectangular, vertically extending attachment channel;

a substantially rectangular attachment member disposed within and extending through said attachment channel and said panels to interconnect said forms to a desired height, whereby an object may be attached to the attachment member through the poured concrete wall; and wherein said attachment channel is rectangular and said attachment member is rectangular or U-shaped.

9. An insulated form assembly for a poured concrete wall comprising:

a plurality of interlocking insulated forms made of a foam material, wherein each of said forms includes two generally planar opposing panels interconnected by a plurality of interior segments defining a plurality of passageways for receiving concrete, and an interlocking portion for fittingly engaging with another of said forms;

each of said panels including a substantially rectangular, vertically extending internal attachment channel; and a substantially rectangular metal attachment member disposed within and extending through said attachment channel and said panels to interconnect said forms to a desired height, whereby an object may be attached to the attachment member; and at least one fastener extending through said foam material to engage said attachment member to attach the object thereto.

10. An insulated form assembly for a poured concrete wall comprising:

a plurality of interlocking insulated forms made of a foam material, wherein each of said forms includes two generally planar opposing panels interconnected by a plurality of interior segments defining a plurality of passageways for receiving concrete, and an interlocking portion for fittingly engaging with another of said forms;

each of said panels including a substantially rectangular, vertically extending attachment channel;

a substantially rectangular attachment member disposed within and extending through said attachment channel and said panels to interconnect said forms to a desired height, whereby an object may be attached to the attachment member through the poured concrete wall; and wherein said attachment member includes an axially extending passageway.

11. An insulated form assembly for a poured concrete wall comprising:

a plurality of interlocking, generally rectangular forms made from a foam material, wherein each of said forms includes two generally planar opposing panels interconnected by a plurality of interior segments defining a plurality of passageways for receiving concrete, and an interlocking portion for fittingly engaging another form;

each of said panels including a substantially rectangular, vertically extending internal attachment channel; and a substantially rectangular metal attachment member integrally disposed within and extending through said attachment channel and said panels to interconnect said forms to a desired height, wherein an object may be attached to the attachment member; and at least one fastener extending through said foam material to engage said attachment member to attach the object thereto.

12. An insulated form assembly as set forth in claim 11 wherein said attachment member is made of a rigid material.

13. An insulated form assembly as set forth in claim 11 including a transversely extending recessed portion and an attaching strip disposed within said recessed portion.

* * * * *